United States Patent [19]

Kinkel

[11] 4,300,641

[45] Nov. 17, 1981

[54] TORQUE RESPONSIVE, DUAL SPEED ROTARY POWER DRIVER

[75] Inventor: Karl Kinkel, Frankfurt am Main, Fed. Rep. of Germany

[73] Assignee: DeMag Aktiengesellschaft, Duisburg, Fed. Rep. of Germany

[21] Appl. No.: 13,073

[22] Filed: Feb. 21, 1979

[30] Foreign Application Priority Data

Feb. 23, 1978 [DE] Fed. Rep. of Germany ..... 2807677

[51] Int. Cl.[3] ..... B25B 23/145

[52] U.S. Cl. ..... 173/12; 81/57.22; 91/59; 92/33; 92/136

[58] Field of Search ..... 173/12; 91/59; 81/57.22; 92/33, 136

[56] References Cited

U.S. PATENT DOCUMENTS 3,438,451 4/1969 Hayes, Jr. .

3,897,834 8/1975 Swopsher et al. ..... 81/57.22 X

FOREIGN PATENT DOCUMENTS 1576142 10/1971 Fed. Rep. of Germany .
2213549 9/1973 Fed. Rep. of Germany .
2316560 10/1973 Fed. Rep. of Germany .
2508971 2/1976 Fed. Rep. of Germany .
2500679 7/1976 Fed. Rep. of Germany .
575214 10/1977 U.S.S.R. ..... 81/57.22

*Primary Examiner*—Robert Mackey
*Attorney, Agent, or Firm*—Mandeville and Schweitzer

[57] ABSTRACT

A rotary power driver is provided which drives with a two-stage torque and speed control, wherein the initial driving is done at higher speed and lower torque, and a subsequent higher torque is automatically imposed with lower speed. The second stage is a selected pre-set stage, with provision for the selected torque built into the driver. The second stage is imposed on the drive shaft by a one-way clutch or ratchet drive.

5 Claims, 1 Drawing Figure

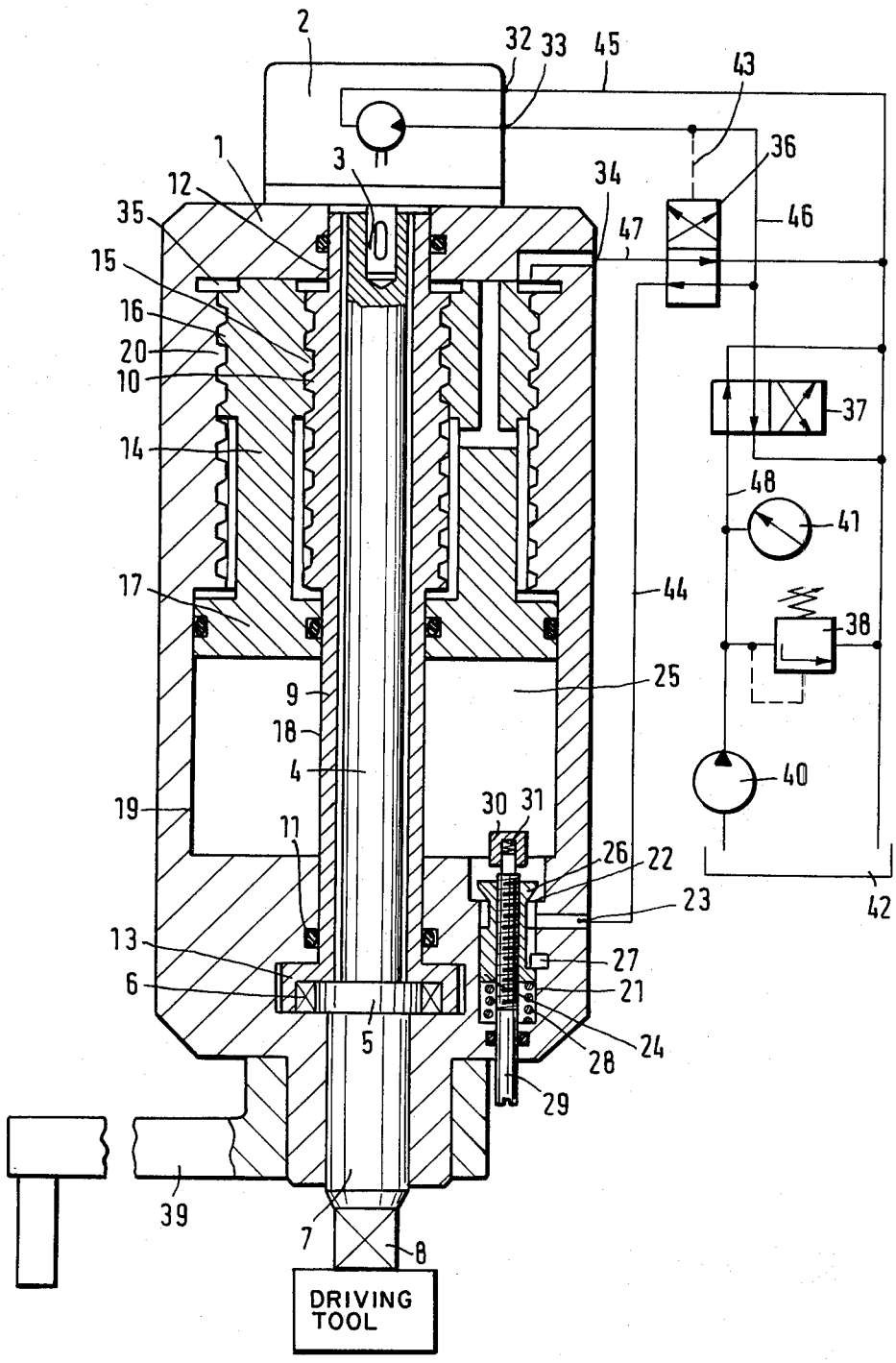
2
32
33
45
43
1
3
36
12
34
35
46
47
15
16
20
10
37
14
48
41
17
44
38
25
9
18
4
40
19
30
31
11
26
22
23
42
13
27
6
21
5
24
28
29
39
7
8
DRIVING TOOL

TORQUE RESPONSIVE, DUAL SPEED ROTARY POWER DRIVER

BACKGROUND AND STATEMENT OF THE INVENTION

The present invention covers a hydraulic rotary driver or screw apparatus with a preset starting torque and a screw shaft, which is connected to a hydraulic motor, to screw a tool, and accommodated within a cylinder. The shaft is driven up to the preset lower torque with higher rotational speed and, after attaining this torque, is automatically coordinated with a further drive element, which drives the screw shaft via a rotary motion transmitting device with higher torque and lower rotational speed.

The assembly of screw connections, particularly in mass production, must make use of handy, fast, and reliable screw tools. Due to the dynamic effects on screw joints, factors come into play in connection with driving tools which may considerably affect the result of the union. Not only the time-dependent starting characteristic of the screw tools, but also the starting angle up to attaining the initial stress forces are important characteristic values.

Pressure medium driven rotary drive tools have been disclosed in German Publication DT-OS 2 213 549 where the screws are initially tightened in two stages by means of an adjustable pre-torque, and then in addition rotated by an adjustable angle value. A two-stage rotary motor is arranged within the screw tool casing. The rotatable casing is connected to another auxiliary motor which helps turn the casing by adjustable angle values. The auxiliary motor to turn the casing is arranged either coaxially with the principle motor or tangentially with the casing.

Furthermore, a screw tool executed as a hand tool has been disclosed in German Publication DT-OS No. 2 316 560 which is equipped with a pressure fluid motor. The motor driven secondary drive shaft, which is fixed to a screw tool, is driven up to a certain torque via an overload clutch detachable by an axial switching movement. Upon attaining this predetermined torque the shaft is driven via a planetary gear and override clutch. The axially movable part of the override clutch is connected with a part of a power cylinder which is charged with pressure when releasing this clutch and which maintains the clutch in released position.

Also, a screw tool has been disclosed in German Publication DT-OS No. 2 508 971 which is provided with an operating cylinder chargeable by a hydraulic medium under pressure. This cylinder is, on one side, hinged at a counterbearing and, on the other side, it acts upon a segment plate rotating on an axis. The operating cylinder is provided with projections engaging with slots arranged in the segment plate. The segment plate, and thus the axle as well, to which a box wrench for the screw union to be tightened may be connected, can then be further rotated, slot by slot, by the engaging projection movable by means of the operating cylinder. This screw tool is used mainly for assembly, maintenance, and repair of large machines with screws of large diameter.

The above mentioned screw tools described are all of a rather complicated construction, and are, accordingly, large and involved and, particularly with smaller pitch circles of the screws—not usable in other applications for screw tools. Furthermore, DT-OS No. 2 500 679 discloses a rotary driver of common design driven by a hydraulic motor, where the required torque is set by means of a pressure check valve.

The invention relates to a hydraulic screw tool or driver of the above mentioned kind eliminating the disadvantages stated, and having a simplified, compact structure. The compact construction is, in particular, to facilitate its use as a screw tool having multiple uses. To this end, the screw tool, equipped with a high-speed gear, is to guarantee exact tension of screws with a preset starting torque and/or rotary angle. Finally, the device has a low energy requirement compared to the existing screw tools of this type.

Rotary drives operated by pressure medium have been disclosed in DT-AS No. 1 576 142 where one cylinder houses an axially movable piston chargeable from both sides. The two front walls of the piston are provided with pins, each provided with a thread. The two threads have opposite convolutions, whereby one thread cooperates with a corresponding inner thread provided in the cylinder, and the second thread with a corresponding thread arranged at the driven pin. With this arrangement, the axial movement of the piston is transformed into a rotary movement of the driven pin. The driven pin rotates around double the turning angle around which the piston rotates. One rotation of the driven pin in both rotary directions requires identical forces. This rotary drive, however, cannot simply be used for a screw tool, as it does not operate with differential rotary speeds and torques required for the individual phases of tightening screws.

The drawing shows an example of the object of the present invention.

DESCRIPTION OF THE DRAWING

The single FIGURE is a somewhat diagrammatic vertical sectional view of a rotary driver, illustrating the invention, and including a schematic indication of the pressure fluid supply control therefor.

DETAILED DESCRIPTION OF THE INVENTION

Referring to the drawing, 1 designates a cylindrical screw tool casing with one end face connected to a hydraulic motor 2 with operating fluid connections 32, 33. The driven shaft 3 of hydraulic motor 2 having a small torque and high rotational speed is coupled with screw or drive tool shaft 4 arranged within the casing. Screw tool shaft 4, near its toolside end, is provided with a drive connection 5 with a freewheel mechanism, such as a one-way clutch connection 6. Shaft 7 of screw tool shaft 4 rotates in the lower tool-side end of casing 1. The exit end of shaft 7 is equipped with a square 8 to receive box wrenches.

Screw tool shaft 4 is surrounded by spaced hollow shaft 9 rotating in casing 1 in bearings 11, 12. The driven end of hollow shaft 9 is provided with an annular drive connection 13, which is connected by one-way clutch (free wheeling or blocking pawl) 6 to screw tool shaft 4 via drive connection or collar 5.

It should be clear that shafts 4 and 7 consist of one piece, i.e., elements 4 and 7 are only parts of a single shaft. A collar 5 is placed between elements 4 and 7. A collar 13 is also provided at the hollow shaft 9 and it is connected with the shaft 4 and/or the collar 5 via the free-wheeling or locking pawl 6. Thus, shaft 4 if rotated by itself will rotate independently of hollow shaft 9.

However, if hollow shaft 9 is rotated, it will cause shafts 4, 7 to rotate since the elements are selectively mechanically interlocked by the free-wheeling or locking pawl 6 which connects collar 13 of hollow shaft 9 to collar 5 of shaft 4.

Hollow shaft 9 is in the upper area facing the hydraulic motor 2, approximately over half its length, equipped with a left-handed or counterclockwise steep thread 10. The hollow shaft 9, in turn, is surrounded by annular piston 17. The annular piston 17 has a piston projection 14 extending axially, being hollow and cylindrical, and surrounding the screw tool shaft 4 and hollow shaft 9. The annular piston 17 extends in a tight fit between exterior 18 of hollow shaft 9 and, the interior of cylinder 1, in the area of recess 19 provided in the cylinder interior.

Piston projection 14 is, at the interior, provided with an internal steep thread 15 matching the steep thread 10, and a right-handed clockwise external steep thread 16. Steep thread 16 engages with internal steep thread 20 provided in the upper part of cylinder 1. Naturally, the internal steep thread 20 is configured to match the external steep thread 16 of annular piston 14.

Piston 17 operates in cylinder chamber 25 extending over the length of recess 19. The bottom of cylinder chamber 25 is provided with a hoist check device, serving also to adjust the rotary angle. This check device consists of a valve guide arranged parallel with the screw tool shaft axis 4. The valve guide is provided with a valve seat 22 and is connected to an operating connection 23. In this manner cylinder chamber 25 may be connected to connection 23 via valve cylinder 21. A valve piston 24 is provided for reciprocation in valve cylinder 21 with a cone-shaped portion matching valve seat 22. Between the bottom of valve cylinder 21 and the lower end face of piston 24 a spring 28 is provided biasing the valve piston 24 upward. Upward movement is limited by pin 27, which simultaneously safeguards it against twisting, so that in this position the valve seat 22 is free and cylinder chamber 25 is connected to operating medium supply line 44. Valve piston 24 houses a threaded spindle 29 which supports a pressure element 30 with spring 31. By adjusting the threaded spindle 29 from the outside, a limitation of the lift and/or angle of rotation may be made.

The uppermost part of the cylinder casing facing the hydraulic motor 2 is provided with another annular cylinder chamber 35 where connection 34 is connected to the operating medium circulating via pipe 47. The hydraulic motor 2 is, on one side, connected at 33 with a pump 40 via operating medium lines 48 and/or 46 and, on the other side, at 32 with a pressure-free container 42. The upper annular cylinder chamber 35 is connected via line 47 and a two-way valve 36, serving as a connecting valve, and via lines 48 and/or 45 either with pump 40 or with container 42. The two way valve 36 is connected to a control line 43 branched off from line 46. The lower cylinder chamber 25 may be connected via line 44, valve 36, and line 48 and/or 45 either with pump 40 or container 42. The pressure line 48 and/or 46 houses another two-way valve 37 serving to connect or disconnect the screw tool. Valve 37 may be operated manually or by means of electro-magnets, or pneumatically, or by any other known method. In the embodiment shown in the drawing, it is contemplated that valve 37 be manually operated, i.e., pressed down by hand and held in that position until the pressure gauge or manometer 41 shows the maximum desired pressure, whereupon the valve is released.

The mode of operation of the screw tool is as follows: The operating medium delivered by pump 40 is, after switching over valve 37 into return position, brought to hydraulic motor 2 via operating medium line 46. The operating medium leaving hydraulic motor 2 is brought to the pressure-free tank 42 via line 45. At the same time the pressure medium reaches, via valve 36 switched in forward position and line 44, past valve seat 22, annular chamber 25, charges the lower face of piston 17, thus holding the latter in the position shown in the drawing. Hydraulic motor 2 with low torque and high rotary speed now turns, with its drive shaft 3, screw tool shaft 4. Freewheel clutch 6 is open. The screw and/or nut is quickly screwed in and/or on with low torque, until the torque of the hydraulic motor is no longer sufficient. At this moment, due to the increasing pressure of the operating medium in line 46, valve 36 is actuated via control line 43. Valve 36 responds automatically to an increase in pressure in line 46. The change-over pressure for this operation is adjustable. When valve 36 is operated, the operating medium is brought into the annular chamber 35 by means of line 47. During this operation piston 17 moves down. Piston 17 is given a rotary motion during its axial movement, as chamber 35 is filled, by the cooperation of helical threads 16 and 20. The pressure medium from annular chamber 25 is forced past valve seat 22 into line 44, past valve 36, and line 45 into tank 42. Annular piston 14 moves down and causes, via cooperating steep threads 10, 15, 16, 20, rotation of hollow shaft 9 and the latter receives screw tool shaft 4 via drive connection 13, freewheel clutch 6 and drive connection 5.

At this point, the screw and/or nut is tightened with an adjustable torque according to the setting at pressure check valve 38. The adjusted pressure may be read on manometer 41. If a certain tightening limit is to be maintained, the lift of the annular piston 14 and, accordingly, the rotation of hollow shaft 9 and/or screw tool shaft 4 are adjustably limited by means of lift check device 21, 22, 24, 26, 27, 28, 29, 30, 31. If piston 17 presses on pressure element 30 of the lift check device, valve piston 24 is pushed down against spring 28 via spring 31 and threaded spindle 29, until cone 26 rests in valve seat 22, thus blocking further drain of the pressure medium from annular chamber 25. In this fashion the lift of annular piston 14 is hydraulically limited. Simultaneously, also, the angle of rotation of screw tool shaft 4 is limited. The respective setting of the tightening limit is done by means of threaded spindle 29. Upon termination of the rotary process, the operation of the two-way valve 37 has been concluded. The two-way valve 37 is returned to the initial position indicated in the drawing by means of a spring which is found in all two-way valves. Thus, line 46 becomes pressure free as does control line 43. Valve 36 also is provided with a spring as is conventional with these types of valves. This spring brings the valve into the position shown in the drawing. Only the working piston 17 of the rotary tool is restored to its original position, i.e., the piston is located such that chamber 25 is fully opened. For operating the two-way valve 37 for a subsequent rotary process, the pressure medium enters line 46, as well as line 44, which causes the fluid to flow into chamber 25. This brings the working piston 17 into its original, ready-to-work position, as shown in FIG. 1. After tightening the screw, the two-way valve 37 is switched into forward position so that the operating medium flows from pump 40—should the latter not be disconnected—via line 45 into tank 42.

To receive the reacting moment, particularly when using the tool as single-acting screw tool, a counterbearing 39 is provided which is fixed to casing 1. If several screw tools are combined as a multiple screw tool (e.g. for automobile wheels), the counterbearing may be deleted, since the reacting forces are received by the next screws and/or nuts. The counterbearing 39 is rigidly connected to the cylindrical casing 1. Counterbearing 39 serves to accommodate the starting torque if only one screw is to be tightened with the apparatus. On the other hand, if a plurality of screws, for example, arranged in a row, are to be tightened, the function of the counterbearing is cancelled.

In operation, however, the peg of counterbearing 39 extending downwardly in FIG. 1, reaches into a hole or recess provided in the element to be bolted. This serves to securely hold the apparatus to the element and prevent rotation of the apparatus at the expense of loss of rotation of the bolt.

I claim:

1. A pressure fluid driven rotary tool apparatus, having a predetermined tightening torque and tightening limit, comprising:

(a) a source of pressure fluid;

(b) a tool casing;

(c) a drive shaft in said casing;

(d) a drive motor connected to one end of said drive shaft for rotating said drive shaft at high speed at predetermined low tightening torque;

(e) pressure fluid flow communication means between said source and said motor;

(f) a driving tool fixed to said drive shaft at the end thereof opposite said motor;

(g) a piston in said casing coaxial with said drive shaft, said piston being axially displaceable in said casing; said apparatus characterized by (h) a drive element in said casing, said drive element coaxially positioned between said drive shaft and said piston;

(i) means for connecting said drive shaft and said drive element in one direction of rotation upon said drive shaft reaching said predetermined tightening torque for rotating said drive shaft and driving tool at low speed at predetermined high tightening torque;

(j) said connecting means including (i) a one-way clutch type mechanism and (ii) means for converting the axial displacement movement of said piston into rotary movement for said drive element; and (k) adjustable first valve means which effects said connecting means when the pressure of said pressure fluid obtains a preselected pressure.

2. The apparatus of claim 1, further characterized by (a) a hollow cylindrical extension on said piston;

(b) said connecting means including cooperating axially extending helical drive threads between said piston and said casing wall, and between said piston and said drive element.

3. The apparatus of claim 2, further characterized by (a) said cooperating helical drive threads having a large angle of inclination from the axis of said tool.

4. The apparatus of claim 1, further characterized by (a) a pressure fluid connection in the bottom end wall of said casing;

(b) means in said flow communication means providing connection between said pressure fluid connection and said source;

(c) second valve means in said pressure fluid connection;

(d) adjustable bias means in said second valve means for biasing said second valve means into open position; and (e) whereby the axial displacement of said piston toward said bottom end wall causes said piston to move against said bias means, closing said second valve means.

5. The apparatus of claim 4, further characterized by said adjustable bias means including (a) an adjustable spindle in said second valve means and extending through said bottom end wall for the adjustment of said adjustable bias means.

* * * * *